United States Patent [19]

Oros

[11] 4,334,297

[45] Jun. 8, 1982

[54] GLOBE CLOCK DEVICE AND METHODS OF MAKING AND USING THE SAME

[76] Inventor: Gerald D. Oros, 451 Olian, Hazelwood, Mo. 63042

[21] Appl. No.: 161,751

[22] Filed: Jun. 23, 1980

Related U.S. Application Data

[63] Continuation-in-part of Ser. No. 28,260, Apr. 9, 1979.

[51] Int. Cl.[3] ..... G04B 19/26

[52] U.S. Cl. ..... 368/18; 368/15

[58] Field of Search ..... 33/1 SC; 35/43, 42.5, 35/45, 46 R, 47; 362/806, 809, 811; 368/15-20, 67, 227

[56] References Cited

U.S. PATENT DOCUMENTS

| | | | |
|---|---|---|---|
| 1,750,505 | 3/1930 | Bulka | 368/16 |
| 2,994,984 | 8/1961 | Luchsinger | 35/47 |
| 3,010,224 | 11/1961 | Roberts | 35/45 |
| 3,028,687 | 4/1962 | Johnson | 35/46 R |
| 3,086,299 | 4/1963 | Wilkerson | 35/46 R |
| 3,766,727 | 10/1973 | Didik | 368/15 |

*Primary Examiner*—Ulysses Weldon

[57] ABSTRACT

The present invention relates to a globe clock which includes an earth sphere rotating at a rate of 1 revolution per minute, a moon sphere orbiting the earth sphere at a rate of one revolution per 12 hours and a satellite sphere orbiting the earth sphere at a rate of one revolution per hour, all mounting in a black housing and immersed in "black light".

3 Claims, 2 Drawing Figures

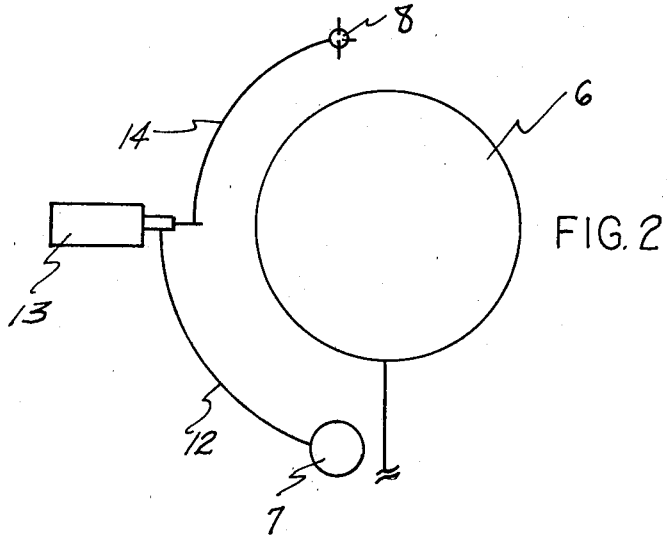
FIG. 2
FIG 1
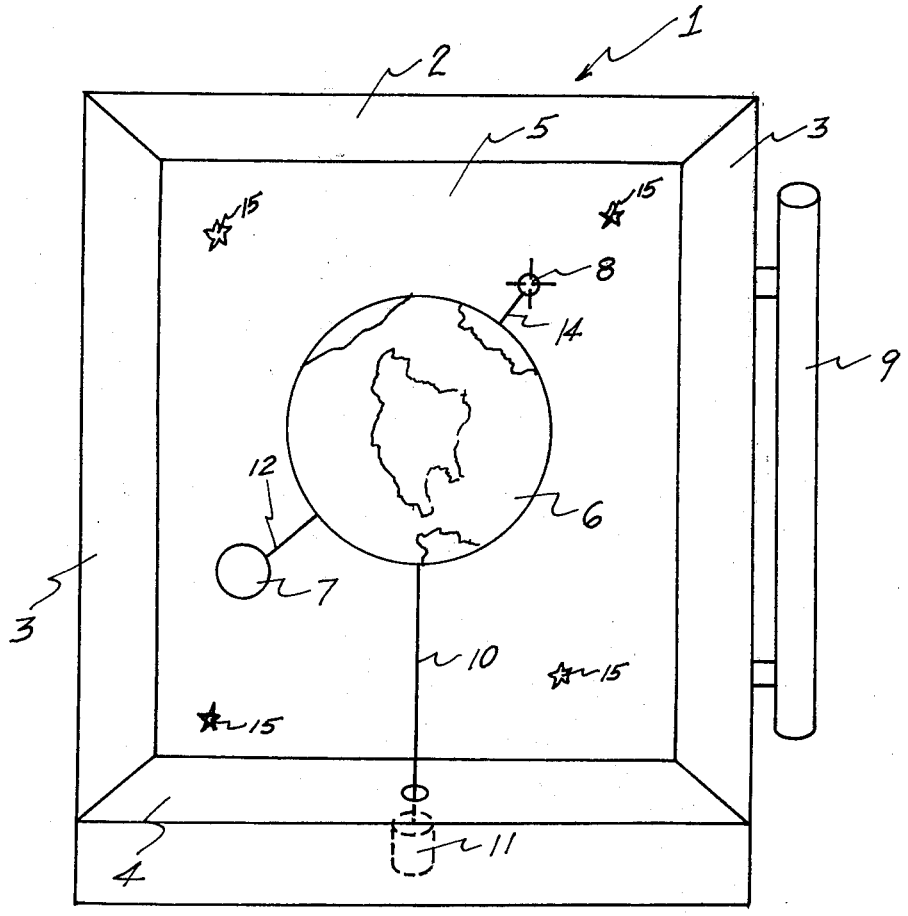

GLOBE CLOCK DEVICE AND METHODS OF MAKING AND USING THE SAME

BACKGROUND OF THE INVENTION

This application is a continuation-in-part of application Ser. No. 28,260 filed Apr. 9, 1979, now pending before the U.S. Patent Office.

Conventional techniques for displaying time are well known to all and includes numerical displays, rotating hands and the like.

Many clocks are constructed to provide educational information as well as time and are designed to assist young people in learning to tell time.

SUMMARY

It is therefore an object of the present invention to provide a globe clock device which includes an earth sphere, moon sphere and satellite sphere rotating at rates which yields the hour, minute and second.

An object of the present invention is to provide such a device which is educational and attractive.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which:

BRIEF DESCRIPTION OF THE DRAWINGS

In the drawings:

FIG. 1 is an elevation view of a globe clock device constructed in accordance with and embodying the present invention.

FIG. 2 is a side view of the device in FIG. 1.

DETAILED DESCRIPTION OF THE INVENTION

Referring now in more detail and by reference characters to the drawings which illustrate practical embodiments of the present invention, FIG. 1, is an elevation view of a globe clock 1, constructed in accordance with, used in and embodying the present invention.

As shown in FIG. 1, globe clock device 1, comprises housing 2, which is provided with recessed sides 3, top walls 4, and back wall 5, earth sphere 6, moon sphere 7, satellite sphere 8, and light source 9.

Referring to FIGS. 1 and 2, it is seen that in the preferred embodiment of the invention, earth sphere 6, is supported on shaft 10, which is coupled to motor 11, which rotates earth sphere 6, at a rate of 1 revolution per minute, thereby performing the function of a second hand. Moon sphere 7, is supported by arm 12, which is connected to the hour shaft of clock motor 13, and satellite sphere 8, is supported by arm 14, which is connected to the minute shaft of clock motor 13, In the preferred embodiment the surfaces of sides 3, walls 4, and 5, arms 12, and 14, and shaft 10, are painted black. With light source 9, being a source of "black light", long wave ultra violet, the surfaces of the three spheres appear illuminated and the black surfaces are essentially not visible giving the appearance that the three spheres are suspended in space. Additional "star" indicia 15, may be placed on the surfaces of walls 3, 4, and 5.

It should be understood that changes and modifications in the form, construction, arrangement, and combination of the globe clock device and methods of making and using the same may be made and substituted for those herein shown and described without departing from the nature and principle of my invention.

I claim:

1. A globe clock comprising, housing means, said housing means provided with an enclosure comprising a vertical back wall and side walls and a top and bottom wall, an earth sphere rotatably mounted in said enclosure, said earth sphere rotating on and about an axis which is essentially vertical and which is parallel to said back wall, the width of said walls proximate the diameter of said earth sphere, a moon sphere rotatably mounted on a suspension arm within said enclosure means and disposed to orbit about said earth sphere, the axis of rotation of the moon sphere essentially perpendicular to said back wall and the axis of said earth sphere, a satellite sphere rotatably mounted on a suspension arm within said enclosure means and disposed to orbit about said earth sphere, the axis of rotation of the satellite sphere essentially perpendicular to said back wall and the axis of said earth sphere, first motor means operably mounted in said housing, connected to the axis of said earth sphere and disposed external to said enclosure, second motor means operably mounted in said housing to the rear of the earth sphere and concealed from view by the earth sphere and connected to the axis of said moon sphere and the axis of said satellite sphere causing the moon sphere to rotate one revolution per 12 hours and causing the satellite to rotate one revolution per hour, said moon sphere and said satellite sphere disposed and functioning as the hour and minute indicia respectively.

2. A globe clock as described in claim 1 in combination with a light source.

3. A globe clock as described in claim 2 wherein the walls, top and bottom of said housing means and the suspension arms are painted black and said light source is a source of black light.

* * * * *